US005237135A

United States Patent [19]

Wolski

[11] Patent Number: 5,237,135

[45] Date of Patent: Aug. 17, 1993

[54] OMNI-DIRECTIONAL INERTIA SWITCHING DEVICE

[75] Inventor: Raymond Wolski, New Britain, Conn.

[73] Assignee: Raymond Engineering Inc., Middletown, Conn.

[21] Appl. No.: 932,329

[22] Filed: Aug. 19, 1992

[51] Int. Cl.[5] ..... H01H 35/14

[52] U.S. Cl. ..... 200/61.45 R; 200/DIG. 29

[58] Field of Search ..... 200/5 A, 61.45 R-61.53, 200/DIG. 29; 307/121

[56] References Cited

U.S. PATENT DOCUMENTS

| | | | |
|---|---|---|---|
| 3,368,044 | 2/1966 | Green et al. | 200/61.45 R |
| 3,453,405 | 9/1966 | Gasik | 200/61.45 R |
| 3,727,209 | 4/1973 | White et al. | 200/61.49 X |
| 3,742,157 | 6/1973 | Leposavic | 200/5 A |
| 3,764,820 | 10/1973 | White et al. | 200/61.43 R X |
| 3,818,160 | 6/1974 | Hitchcock | 200/61.45 R |
| 4,071,723 | 1/1978 | Jackman | 200/61.45 R |
| 4,191,869 | 3/1980 | Tanaka et al. | 200/61.45 R |
| 4,594,485 | 6/1986 | Brown, Jr. | 200/61.45 R |
| 5,092,172 | 3/1992 | Overman et al. | 200/61.45 R X |

*Primary Examiner*—J. R. Scott

*Attorney, Agent, or Firm*—Fishman, Dionne & Cantor

[57] ABSTRACT

An omni-directional inertia switching device is presented. The inertia switching device comprises a housing having a conically shaped upper portion for retaining a ball member within the housing. The ball member is supported by a flat spring having a star shaped opening therethrough. The flat star spring is comprised of electrically conductive material. A lower contact member and the conductive flat star spring are separated by an insulator except for a central opening corresponding to the portion of the flat star spring where the ball member is located. Further, the flat star spring and the lower contact member have terminals which extend from the housing for connection with an external device. The device of the present invention is actuated when a preselected amount of inertia force causes the ball to overcome the biasing forces of the flat star spring bringing the flat star spring and the lower contact member into electrical contact. The inertia switching device may be ganged to define a digital switch accelerometer, wherein each switch is configured for an incremental measurement; e.g., increments of 1 g.

18 Claims, 3 Drawing Sheets

OMNI-DIRECTIONAL INERTIA SWITCHING DEVICE

BACKGROUND OF THE INVENTION

The present invention relates to devices which are responsive to inertia. More particularly, the present invention relates to an omni-directional inertia switching device which may be employed individually as an impact switch or ganged to function as an accelerometer.

Inertia responsive devices are well known and used in a variety of applications. In general, a mass is maintained in a first position until a sufficient force is exerted on the device to move the mass to a second position. Examples of such devices are disclosed in U.S. Pat. Nos. 3,368,044; 3,453,405; 3,818,160; 4,071,723; and 4,594,485. The above list is only exemplary and is not intended to be a complete list of the prior art inertia responsive devices.

U.S. Pat. No. 3,368,044 to Green et al discloses an inertia switch having a ball trapped between two cones. A snap action disk is attached to the vertex of the lower cone. An actuating member extends downwardly from the lower cone and the disk. The snap action disk is circular with a plurality of inwardly extending rounded slots about the periphery thereof. The disk has a central opening with a plurality of outwardly extending rounded slots about the periphery of the opening. The shape of the disk when viewed from a side elevation is generally convex. The switch is actuated when a preselected amount of inertia force causes the ball to overcome the disk and force the lower cone and the actuating member downwardly thereby tripping a toggle switch assembly.

U.S. Pat. No. 3,818,160 to Hitchcock discloses an inertia switch having a ball which rests on a surface at the lower portion of a housing. The housing includes a sidewall which defines an opening in which the ball is disposed. An electrically conductive disk is secured at a ledge of the sidewall at the upper portion of the housing. The disk has a central opening and a plurality of inwardly extending slots about the periphery thereof. The shape of the disk when viewed from a side elevation is generally flat. A leaf spring is in electrical contact with the disk and holds the disk away from a conductive ring. Accordingly, a preselected amount of inertia force will cause the ball to push against the disk overcoming the leaf spring which will come into electrical contact with the ring (i.e., actuate the switch).

U.S. Pat. No. 4,594,485 to Brown, Jr. discloses an impact sensor having a ball enclosed in a housing with a spring. The spring is a hemispherically shaped electrically conductive disk. The ball rests on the disk such that a preselected amount of initial force will cause the ball to push against the disk causing it to flip from a concave or open position to a convex or closed position. In the closed position electrical contact is made between the disk having a terminal and a contact also having a terminal. This sensor may be automatically reset if a pivotable arched contact disposed above a deformable closure member is used.

U.S. Pat. Nos. 3,453,405 and 4,071,723 each disclose a ball supported by a spring in a housing. The U.S. Pat. No. 3,453,405 discloses an inertial switch having a coil spring which extends up into an opening in the ball. The U.S. Pat. No. 4,071,723 discloses a wavy spring washer supporting a cup member which supports the ball.

The prior art devices are complex in that each has many components. Further, due to this complexity these prior art devices are relatively large. Accordingly, a need exists for a smaller, less complex inertia device.

SUMMARY OF THE INVENTION

The above-discussed and other problems and deficiencies of the prior art are overcome or alleviated by the inertia switching device of the present invention. In accordance with the present invention, the inertia switching device comprises a housing having a conically shaped upper portion for retaining a ball member within the housing. The ball member is supported by a flat spring having a star shaped opening therethrough. The flat star spring is comprised of electrically conductive material. A lower contact member and the conductive flat star spring are separated by an insulator except for a central opening corresponding to the portion of the flat star spring where the ball member is located. Further, the flat star spring and the lower contact member have terminals which extend from the housing for connection with an external device. The device of the present invention is actuated when a preselected amount of inertia force causes the ball to overcome the biasing forces of the flat star spring bringing the flat star spring and the lower contact member into electrical contact.

In further accordance with the present invention a plurality of these inertia switching devices may be ganged to define a digital switch accelerometer. The digital switch accelerometer comprises a housing having a plurality of spaced conically shaped portions at the top of the housing, each for retaining a ball member within that portion. A flat spring having an array of star shaped openings therethrough supports the ball members, one at each star shaped opening. The pattern of the star shaped openings conforms to the spaced conically shaped portions. The spring is comprised of an electrically conductive material. A lower contact member having a plurality of contact regions and the conductive spring are separated by an insulator except for the openings corresponding to the portion of each star shaped opening where the ball member is located. The contact regions of the contact member are aligned with the openings in the insulating layer. The flat spring has at least one terminal extending from the housing for connection with an electrical device. Each contact region has a terminal extending from the housing for connection with an external device such as to be connected to a microprocessor digital input port or each adjacent contact region is electrically connected via resistive or other elements such as to provide an electrical change with each switch closure. Accordingly, all areas of the flat spring are in electrical contact and each contact region may be isolated from the other or electrically interconnected as set forth above. Each ball member and/or the area around each star shaped opening is configured for incremental measurements; e.g., increments of 1 g. The operation of each switch is analogous to the single switch described above. Accordingly, a digital switch accelerometer in accordance with the present invention is provided.

The present invention differs from the prior art of U.S. Pat. No. 3,368,044 in that the present invention does not employ cones to hold a ball in place with an actuating member extending from one of the cones to trip a toggle switch.

The present invention differs from the prior art of U.S. Pat. No. 3,818,160, in that the present invention does not employ a disk in communication with a leaf spring secured at the upper portion of a housing. In distinct contrast to the present invention, the ball in the device of the U.S. Pat. No. 3,818,160 only comes into physical contact with the disk when electrical contact is to be made between the disk and a conductive ring. The ball member of the present invention is always in contact with the flat star spring.

The present invention differs from the prior art of U.S. Pat. No. 4,594,483 in that the present invention does not employ a disk which flips from a concave to a convex position and which is resettable by a pivotable arched contact disposed on a deformable closure member.

The above-discussed and other features and advantages of the present invention will be appreciated and understood by those skilled in the art from the following detailed description and drawings.

BRIEF DESCRIPTION OF THE DRAWINGS

Referring now to the drawings, wherein like elements are numbered alike in the several FIGURES.

DESCRIPTION OF THE PREFERRED EMBODIMENT

Figure 1:
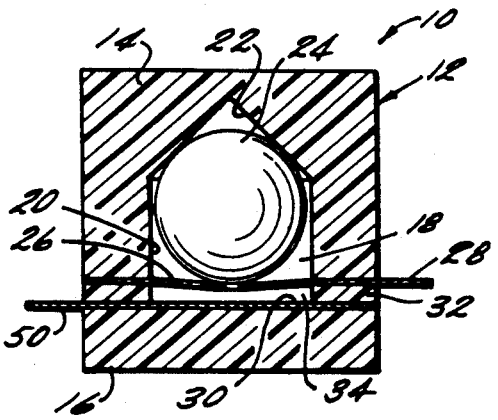
FIG. 1 is a cross-sectional side elevational view of the inertia switching device in the open position in accordance with the present invention.

Referring to FIG. 1, an omni-directional inertia switching device in accordance with the present invention is shown generally at 10. Switch 10 comprises a housing 12 having an upper portion 14 and a lower portion 16; i.e., a base. The upper portion 14 includes a cavity 18 which is defined by a sidewall 20, a conically shaped upper section 22 and is open at the end opposite section 22. Cone 22 preferably has a cone angle between 90° to 120°; however, other cone angles may suffice. Cone 22 has a cone angle of 90° in this example. The lower portion 16 is attached to the upper portion 14 to close off the open end of the cavity 18. A ball member 24 is the mass used to detect the inertia and is preferably comprised of stainless steel. However, any suitable material may suffice to provide the mass and such material is not required to be electrically conductive. Ball member 24 is supported by a flat spring 26 which includes a terminal 28 extending from housing 12. Spring 26 is preferably comprised of high tensile stainless steel, beryllium copper or any other electrically conductive material having sufficient spring characteristics. A lower contact member 30 is separated from spring 26 by an insulating layer 32 except for a central opening 34 corresponding to the location of ball member 24. Insulating layer 32 has a thickness sufficient to allow full deflection of spring 20. Spring 28, insulating layer 32 and contact member 30 are secured between the upper and lower portions 14, 16 of housing 12 by the means for connecting portion 16 to portion 14. The means for connecting may comprise any well known means, e.g., screws, rivets, ultrasonic weld or integrally molded, such as to allow electrical separation between spring 26 and contact member 30.

Figure 2:
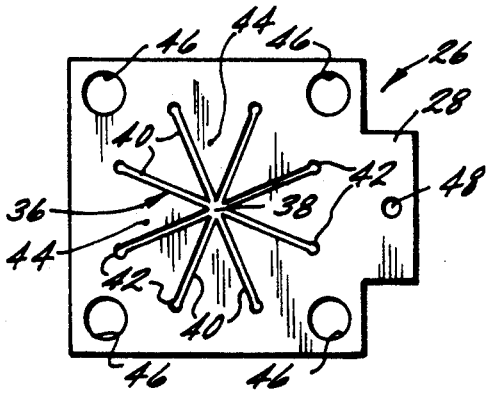
FIG. 2 is a top view of the flat star spring used in the inertia switching device of FIG. 1.

Referring to FIG. 2, spring 26 has a star shaped opening 36 at about the center thereof. Star shaped opening 36 comprises a circular central opening 38 with slots 40 extending outwardly from opening 38, each slot terminating at a remote circular opening 42 remotely located within each slot from the central opening. Opening 36 defines a plurality of wedge shaped spring leaves 44. In this example, eight spring leaves 44 are shown; however, any number of spring leaves may suffice. A plurality of mounting holes 46 are provided to accommodate the connecting means described hereinbefore. Terminal 28 includes a hole 48 for soldering a wire to provide an electrical interconnection to an external device.

Spring 26 is a flat spring when viewed from a side elevation. The leaves 44 are shown slightly deflected in FIG. 1. This deflection by ball member 24 results in a preloading of ball member 24, whereby ball member 24 is biased to press up against the conically shaped upper section 22 of housing 12. Switch 10 as shown in FIG. 1 is in its open position. The open position results when spring 26 and contact member 30 are not in electrical contact. Contact member 30 also has a terminal 50 for electrical connection to an external device. Terminal 50 is similar to terminal 28 of spring 26. Contact member 30 is preferably a flat continuous layer of conductive material with mounting holes corresponding to mounting holes 46 of spring 26. Insulating layer 32 also includes mounting holes which correspond to mounting holes 46.

Figure 3:
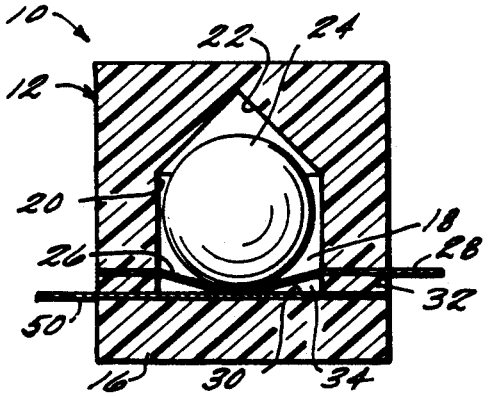
FIG. 3 is a cross-sectional side elevational view of the inertia switching device of FIG. 1 in the closed position.

Switch 10 is actuated when a preselected inertia force causes ball member 24 to overcome the biasing forces of spring 26, whereby ball member 24 forces at least one of leaves 40 of spring 26 into electrical contact with member 30. This is the closed position of switch 10 and is best shown in FIG. 3. The preselected inertia force is determined by the mass of ball member 24, the characteristics of spring 26 and the distance between spring 26 and contact member 30. Changes in either spring 26 shape, material or thickness or insulator 32 thickness together with changes in the preload angle, the amount leaves 40 are deflected, increases or decreases the g-sensitivity.

Switch 10 is sensitive to a cone angle 90°–120° from the vertical. Angles greater than a 120° cone angle are also contemplated by the present invention. Switch 10 is relatively insensitive to changes in the cone angle impact direction. This is a result of the star shaped opening 36 or spring 26. As ball member 24 moves off center due to changes in the angle of attack, ball member 24 moves off of some of the leaves 44 and further onto the other remaining leaves 44. The spring force on any individual leaves 44 increases in a radially outward direction. Accordingly, when member 24 is centered the spring force is provided by the vertex of all of the leaves 40. The vertex of the leaves 44 provides the least spring resistance, however these are combined when the ball member 24 is centered. As the ball 24 moves off center, the overall spring resistance is maintained. This is accomplished by the increased spring resistance on the leaves 44 as the ball 24 moves away from the vertex of some of the leaves, whereby the increased spring resistance on the wider portion of the remaining leaves 44 compensates for the lost spring resistance of the vertex of the leaves 44 off of which ball 24 moved. This insensitivity to the angle of the inertia force is an important feature of the present invention.

Figure 4:
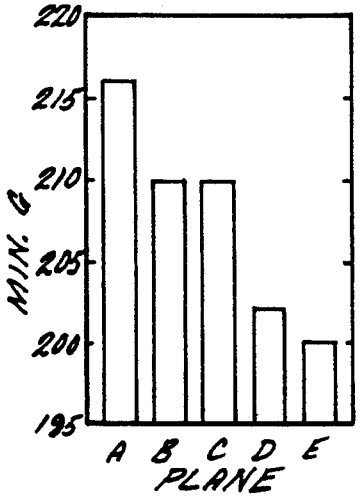
FIG. 4 is a chart illustrating the test results of the inertia switching device of FIG. 1.

Referring to FIG. 4 the results for both vertical and four axes of the 90° cone of switch 10 indicate a fairly sharp 200 g, go-no-go level for which this test was designed. The vertical is defined by plane A which is perpendicular to the base of the switch tested a minimum of approximately 216 g. The four axes are defined by planes B-E which are at 45° angles relative to the base of the switch at about the center of each of the four sides of the switch tested a minimum of approximately 210 g, 210 g, 202 g and 200 g respectively. These results are achievable as a result of the star spring design of the present invention.

Figure 5:
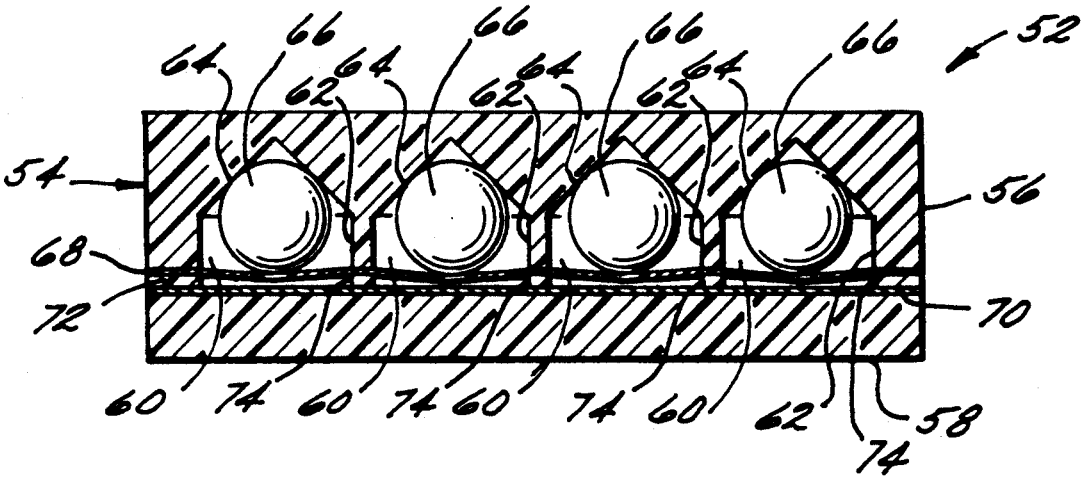
FIG. 5 is a cross-sectional side elevational view of a plurality of the inertia switching devices ganged to function as a digital switch accelerometer in accordance with the present invention.

Referring to FIG. 5, a digital switch accelerometer in accordance with the present invention is shown generally at 52. Accelerometer 52 comprises a housing 54 having an upper portion 56 and a lower portion 58. The upper portion 56 includes a plurality of cavities 60 which are defined by sidewalls 62, conically shaped upper sections 64 and are open at the ends opposite sections 64. Each cone 64 has a cone angle of 120° in this example. The lower portion 58 is attached to the upper portion 56 to close off the open ends of the cavities 60. A ball member 66 is disposed in each cavity 60. Ball members 66 are preferably comprised of stainless steel, however any suitable material may suffice to provide a mass and such material is not required to be electrically conductive. Ball members 66 are supported by a flat spring 68 which includes at least one terminal 70 (FIG. 6) extending from housing 54. Spring 68 is preferably comprised of high tensile stainless steel, beryllium copper or any other electrically conductive material having sufficient spring characteristics. A lower contact member 70 is separated from spring 68 by an insulating layer 72 except for a plurality of openings 74 corresponding to the locations of each ball member 66. Spring 68, insulating layer 72 and contact member 70 are secured between the upper and lower portions 56, 58 of housing 54 by the means for connecting portion 58 to portion 56. The means for connecting may comprise any well known means, e.g., screws, rivets, ultrasonic weld or integrally molded, such as to allow electrical separation between spring 68 and contact member 70.

Figure 6:
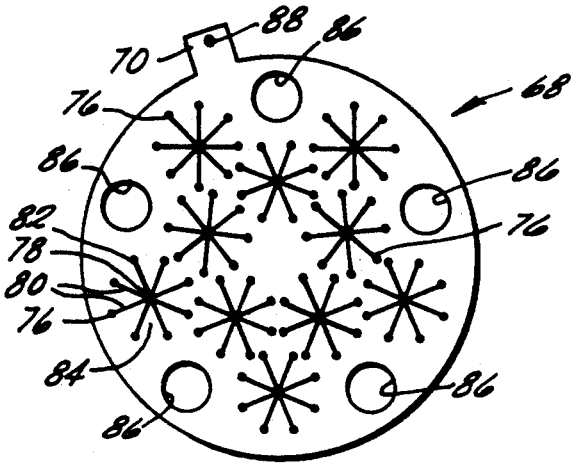
FIG. 6 is a top view of the flat spring used in the digital switch accelerometer of FIG. 5.

Referring to FIG. 6, spring 68 has a plurality of star shaped openings 76, (in this example of ten star shaped openings. Each star shaped opening 76 comprises a circular central opening 78 with slots 80 extending outwardly from opening 78 each slot terminating at a remote circular opening 82 remotely located within each slot from the central opening. Opening 76 defines a plurality of wedge shaped spring leaves 84. A plurality of mounting holes 86 are provided to accommodate the connecting means described hereinbefore. Terminal 70 includes a hole 88 for soldering a wire to provide an electrical interconnection to an external device.

Spring 68 is a flat spring when viewed from a side elevation. The leaves 84 at each opening 76 are shown slightly deflected in FIG. 5. This deflection by ball members 66 results in a preloading of the ball members 66, whereby each ball member 66 is biased to press up against each corresponding conically shaped upper section 64 of housing 54.

Each ball member 66 and corresponding star shaped opening 76 of spring 68 are designed to actuate at increasing incremental levels; e.g., one-g increments, half-g increments, quarter-g increments, etc. In the present example, ten switches are ganged to provide the digital switch accelerometer with a range of 0–10 g's at one-g increments. Additional switches can be added to increase the range or decrease the magnitude of the increments. It will be appreciated that any number of switches may be ganged and any incremental step may be employed without departing from the spirit or scope of the present invention.

The sensitivity of each switch is preferably determined by adjusting the shape or thickness of the leaves to achieve the desired result; i.e., the thicker the leaves the higher the g value for that switch. While this method is preferred, any of the aforementioned methods discussed in the FIG. 1 embodiment may be employed.

Figure 7:
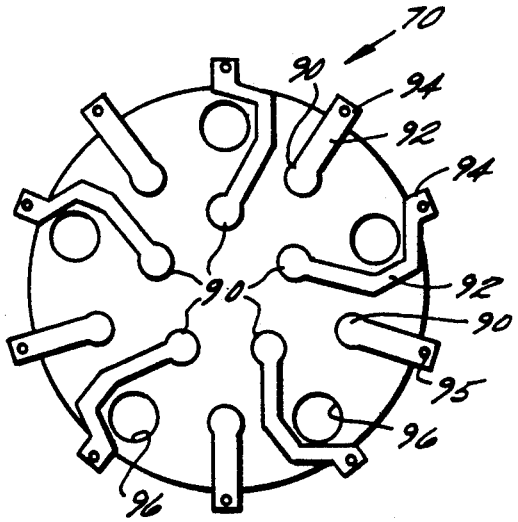
FIG. 7 is a top view of the contact member used in the digital switch accelerometer of FIG. 5.

Referring to FIG. 7 contact member 70 includes a plurality of conductive pads 90 which are aligned with openings 76 of spring 68. For microprocessor digital applications, each pad 90 has a conductive trace 92 terminating in a tab 94. Each tab has a hole 95 for soldering a wire to provide an electrical interconnection to an external device. Each of the pads 90 is electrically isolated from each of the other. Pads 90 and traces 92 are preferably plated on the surface of an electrically nonconductive material; e.g., fiberglass, silicon or other suitable material. Contact member 70 includes a plurality of mounting holes 96 which align with holes 86 of spring 68. Insulating layer 72 also includes mounting holes which correspond to holes 86 of spring 68.

The switches shown in FIG. 5 are shown in the open position. The open position of a switch results when none of the leaves 84 of the switch are in electrical contact with the corresponding pad 90. The closed position results when at least one of the leaves 84 of the switch is in electrical contact with the corresponding pad 90. The actuation of the switches is entirely analogous to that of the switch of the FIG. 1 embodiment.

Figure 9:
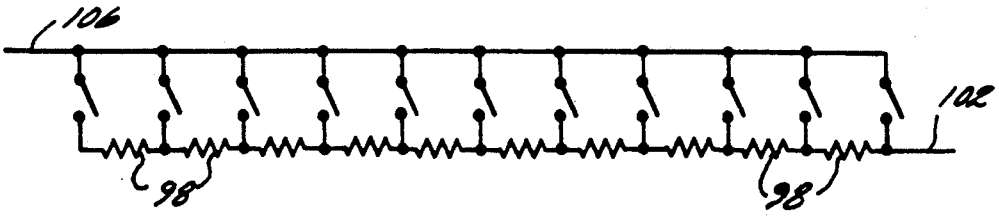
FIG. 9 is a schematic diagram of the contact member of FIG. 8.
Figure 8:
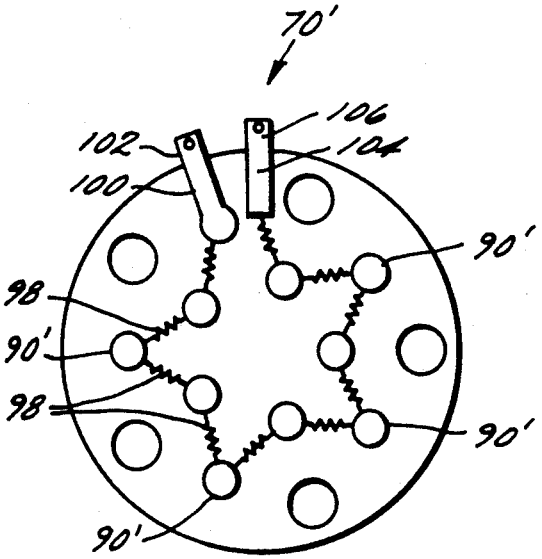
FIG. 8 is a diagramatic top view of the contact member used in the digital switch accelerometer of FIG. 5 in accordance with an alternate embodiment of the present invention.

Referring to FIG. 8 an alternate embodiment of the contact member is shown generally at 70'. Contact member 70' includes a plurality of conductive pads 90' which are aligned with openings 76 of spring 68. Each pad 90' is connected to an adjacent pad 90' by resistive or other elements 98; preferably printed resistors. One of the pads 90' includes a conductive trace 100 terminating in a tab 102. One other of the pads 90' includes a resistive element 98 connecting to a conductive trace 104 terminating in a tab 106. The resistive elements change the output value of resistance as measured at tabs 102 and 106. Each tab has a hole 108 for soldering a wire to provide an electrical interconnection to an external device. Pads 90' and traces 100, 104 are preferably plated on the surface of an electrically nonconductive material, as described hereinbefore. Further, mounting holes 96' are provided as described in the preferred embodiment. The above is schematically illustrated in FIG. 9 wherein the resistors 98 are connected in parallel with each corresponding switch closure.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. An inertia switching device comprising:

a housing having an internal side wall extending between a conically shaped portion at one end of the housing and an opening at the other end of the housing;

a spring secured to said housing, said spring having a star shaped opening in general alignment with the opening in said housing, said star shaped opening defining a plurality of leaves, said spring being electrically conductive, said spring including means for electrically interconnecting said spring to an external device;

a mass being disposed within said side walls and supported by said leaves of said spring; and a contact member being electrically conductive and including means for electrically interconnecting said contact member to an external device, said contact member being spaced apart from said spring to define a gap wherein at least one of said leaves deflects in response to said mass reacting to inertia forces, whereby at least one of said leaves comes into electrical contact with said contact member when the inertia forces exceed a preselected limit.

2. The device of claim 1 further comprising:

an insulating layer disposed between said spring and said contact member, said insulating layer having an opening aligned with said star shaped opening of said spring wherein said gap is defined.

3. The device of claim 1 further comprising:

a base secured to said housing, said spring and said contact layer being disposed between said base and said housing.

4. The device of claim 1 wherein said mass comprises a ball.

5. The device of claim 1 wherein said star shaped opening comprises a circular central opening with slots extending outwardly therefrom defining a plurality of wedge shapes whereby said wedge shapes are said leaves.

6. The device of claim 5 wherein each of said slots terminate in a circular opening.

7. The device of claim 1 wherein said conically shaped portion has a cone angle between about 90° and about 120°.

8. A digital switch accelerometer comprising:

a housing having a plurality of cavities with internal side walls, each of said internal side walls extending between a corresponding conically shaped portion at one end and a corresponding opening at the other end;

a spring secured to said housing, said spring having a plurality of star shaped openings, each being aligned with the corresponding opening in said housing, each of said star shaped openings defining a plurality of leaves, said spring being electrically conductive, said spring including means for electrically interconnecting said spring to an external device;

a plurality of masses, each of said masses being disposed within its said corresponding side walls and supported by said leaves of said corresponding star shaped opening; and a contact member having a plurality of electrically conductive contact pads, one of said pads aligned with each of said star shaped openings, said contact member including means for electrically interconnecting each of said pads to an external device, said contact member being spaced apart from said spring to define a gap wherein at least one of said leaves from each of said star shaped openings deflect in response to said masses reacting to acceleration forces, whereby at least one of said leaves from each of said star shaped opening comes into electrical contact with said corresponding pad when the acceleration forces exceed a corresponding preselected limit, each of said corresponding mass, star-shaped opening and pad being responsive to a different preselected limit.

9. The accelerometer of claim 8 wherein said preselected limits increase incrementally for each said corresponding mass, star-shaped opening and pad.

10. The accelerometer of claim 8 further comprising:

an insulating layer disposed between said spring and said contact member, said insulating layer having a pluraltiy of openings, each of said openings in said insulating layer aligned with said corresponding star shaped opening and said corresponding pad wherein a pluraltiy of said gaps are defined.

11. The accelerometer of claim 8 further comprising:

a base secured to said housing, said spring and said contact layer being disposed between said base and said housing.

12. The accelerometer of claim 8 wherein each of said masses comprises a ball.

13. The accelerometer of claim 8 wherein said star shaped openings each comprise a circular central opening with slots extending outwardly therefrom defining a plurality of wedge shapes whereby said wedge shapes are said leaves.

14. The accelerometer of claim 13 wherein each of said slots terminate in a circular opening.

15. The accelerometer of claim 8 wherein said conically shaped portions each have a cone angle between about 90° and about 120°.

16. The accelerometer of claim 8 wherein said means for electrically interconnecting each of said pads to an external device comprises:

a trace extending from each of said pads, each of said traces terminating in a tab for providing connection to the external device, each of said pads being electrically isolated from each of said other pads.

17. The accelerometer of claim 8 wherein said means for electrically interconnecting each of said pads to an external device comprises:

first resistor means connected between said pads;

a first trace extending from one of said pads, said first trace terminating in a first tab for providing connection to the external device;

second resistor means connected to one of said pads; and a second trace connected to said second resistor means, said second trace terminating in a second tab for providing connection to the external device.

18. The accelerometer of claim 17 wherein each of said first and second resistor means comprises:

a printed resistor element.

* * * * *